United States Patent [19]

Lin et al.

[11] Patent Number: 4,996,856

[45] Date of Patent: Mar. 5, 1991

[54] STRUCTURE OF CYLINDER LOCK

[76] Inventors: Peir-Kuen Lin, 4F, No. 49, An Leh Street; C. H. Hwang, No. 14, Alley 6, Lane 315, Chung Cheng N. Rd., both of Sanchung, Taipei Hsien, Taiwan

[21] Appl. No.: 509,510

[22] Filed: Apr. 16, 1990

[51] Int. Cl.[5] ..... E05B 21/04

[52] U.S. Cl. ..... 70/359; 70/395; 70/491

[58] Field of Search ..... 70/359, 491, 35 B, 490, 70/395

[56] References Cited

U.S. PATENT DOCUMENTS

| | | | |
|---|---|---|---|
| 3,125 | 6/1843 | Voorhies | 70/359 |
| 1,095,500 | 5/1914 | Hansen | 70/359 |
| 1,741,390 | 12/1929 | Wise | 70/359 |
| 3,818,732 | 6/1974 | Tria | 70/359 |
| 3,878,700 | 4/1975 | Lopez | 70/491 |
| 4,328,691 | 5/1982 | Scherbing | 70/491 |

*Primary Examiner*—Robert L. Wolfe

*Attorney, Agent, or Firm*—Wenderoth, Lind & Ponack

[57] ABSTRACT

A cylinder lock includes a cylindrical housing connected with a circular insert at its bottom to receive therein a movable barrel and a fixed barrel. A plurality of lock pin assemblies are set in a plurality of pin holes vertically through the movable lock barrel to control the connection of the movable lock barrel with the fixed lock barrel by use of the various stepped pins of an authorized key. The stepped pins can be detached from the key for keeping separately.

20 Claims, 4 Drawing Sheets

STRUCTURE OF CYLINDER LOCK

BACKGROUND OF THE INVENTION (a) Field of the Invention

The present invention relates to cylindrical locks and more particularly to a cylinder lock which comprises a movable lock barrel matching with a fixed lock barrel to form a plurality of passage ways for the insertion therein of a plurality of stepped pins of a key to control its locking and unlocking. The stepped pins of the key can be separated therefrom for keeping by different people or in different locations. An alarm device is connected to the lock to produce alarm signal when an unauthorized key or other object is used to unlock the lock.

(b) Description of the Prior Art

A conventional cylinder lock is generally comprised of a cylindrical housing having received therein a lock barrel. In the lock barrel, a plurality of tumbler pins in different size are transversely movably set to aim at a plurality of driver pins. When an authorized key is inserted in the lock barrel, the steps of the key can be turned to push the tumbler pins to drive the driver pins to turn the lock barrel to rotate so as to further drive a spring bolt to move forward or backward. One disadvantage of this type of cylinder lock is that the driver pins of the lock barrel are difficult to process and easy to break. Another disadvantage of the this type of cylinder lock is its limitation to the specification configurations.

SUMMARY OF THE INVENTION

An object of the present invention is to provide a cylinder lock, in which a plurality of lock pin assemblies are set in a plurality of stepped pin holes through a movable lock barrel to match with a fixed lock barrel for controlling the locking and unlocking of the lock body by means of a plurality of stepped pins.

Another object of the present invention is to provide a cylinder lock, in which an alarm device is connected to produce an alarm signal when an unauthorized key or other object is used to unlock the lock.

Still another object of the present invention is to provide a cylinder lock, in which the key comprises a plurality of releasable stepped pins which can be separated therefrom for keeping by different people or in different locations.

DETAILED DESCRIPTION OF THE PREFERRED EMBODIMENTS

Figure 1:
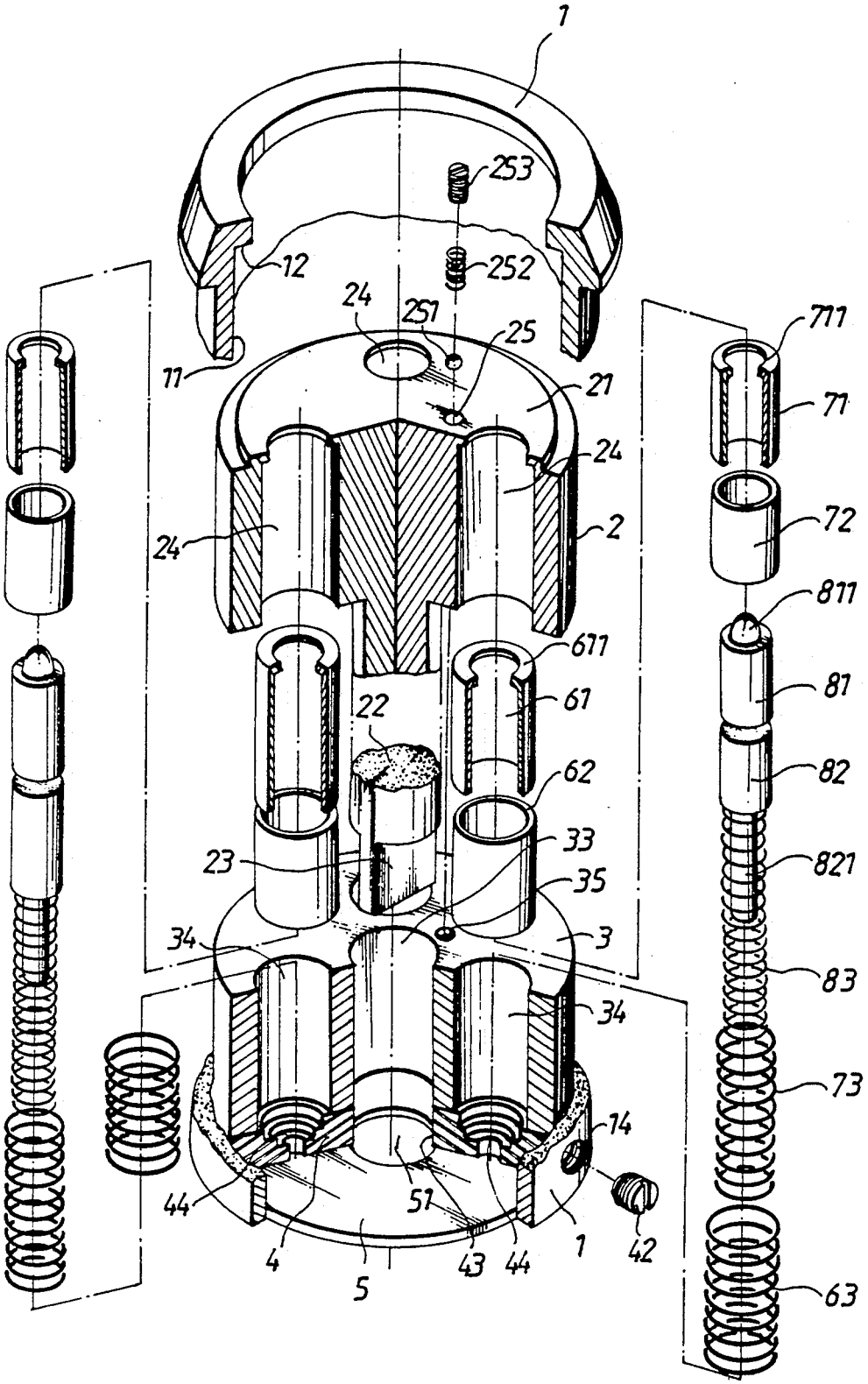
FIG. 1 is a perspective exploded view of a lock body according to the present invention.
Figure 2:
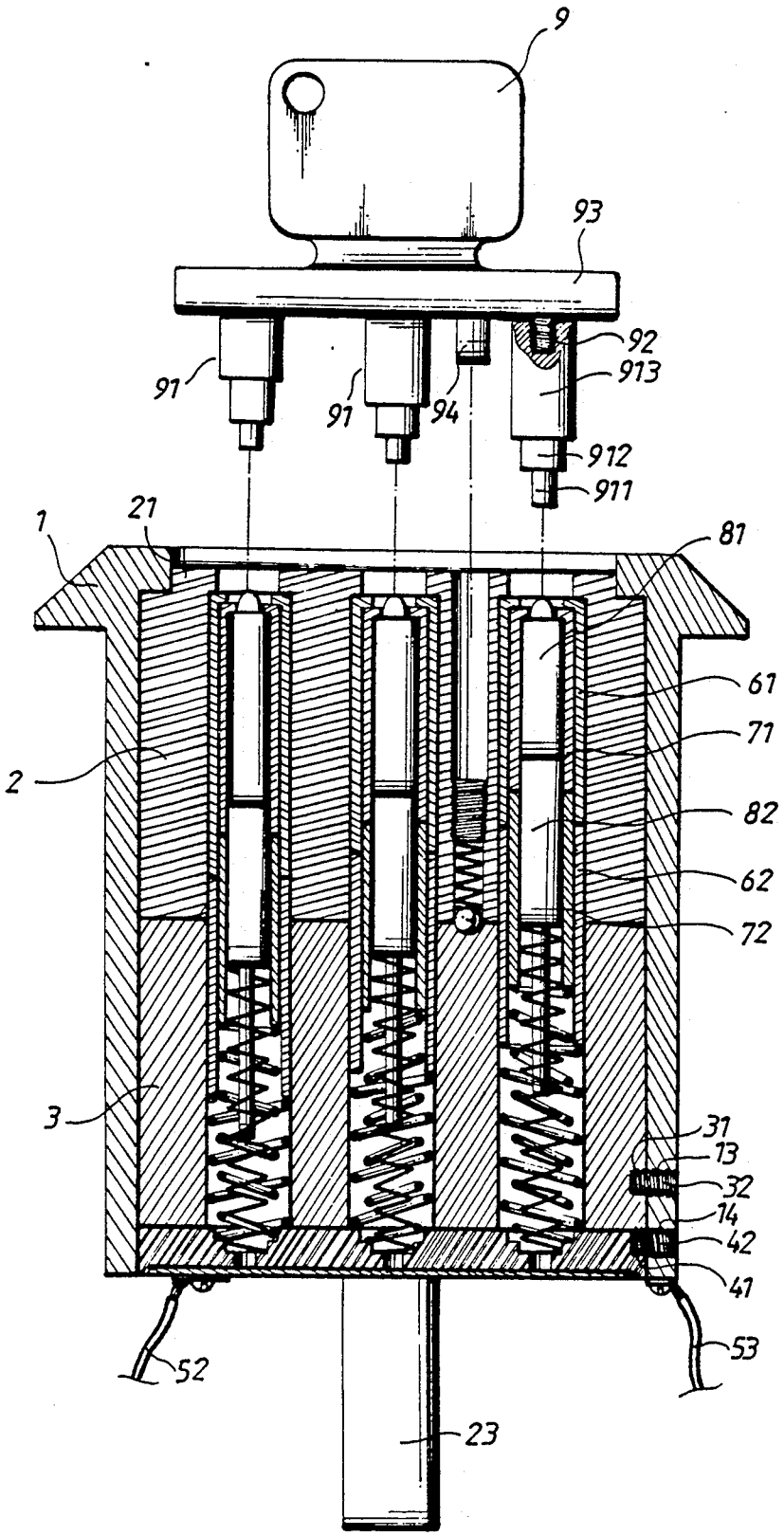
FIG. 2 is a sectional elevation view of a lock body and a schematic structural view of a key according to the present invention.

Turning now to the annexed drawings in greater detail and referring first to FIGS. 1 and 2, therein illustrated is a lock body of a cylinder lock in accordance with the present invention generally comprised of a housing 1, a movable barrel 2, a fixed barrel 3, a circular insert or circular plate 4, and a conductive plate 5.

As illustrated, the housing 1 is in a cylindrical shape having a front stopping flange 12 with an inside diameter slightly smaller than the bore 11 of the housing, and two bolt holes 13 and 14 transversely through its wall surface at its lower end.

The movable barrel 2 is received in the bore 11 of the housing 1 with its top flange 21 stopped against the front stopping flange 12 of the housing 1 to reinforce its engagement with the housing 1, and comprises a unitary circular axle 22, which comprises a flat driving plate portion 23 at its bottom end, extending downward therefrom, a plurality of stepped pin holes 24 vertically penetrating therethrough, and a vertical alignment hole 25 which has an inner thread at its lower end.

The fixed barrel 3 is received in the housing 1 right below the movable barrel 2 and comprises a bolt hole 31 of the same size as the upper bolt hole 13 of the housing 1 such that a bolt 32 can be inserted therein from the upper bolt hole 13 to firmly secure the fixed barrel 3 to the housing 1, an axle hole 33 through its central axis for the insertion therein of the circular axle 22 of the movable barrel 2, a plurality of pin holes 34 and a circular recess 35 respectively corresponding to the pin holes 24 and the alignment hole 25 of the movable barrel 2.

The circular insert 4 is made of insulating material and received in the housing 1 at the bottom thereof right below the fixed barrel 3. A bolt hole 41 is formed in the circular insert 4 to communicate with the lower bolt hole 14 of the housing 1 such that a bolt 42 can be inserted therein from the lower bolt hole 14 to secure the circular insert 4 to the housing 1 so as to enclose the fixed barrel 3 and the movable barrel 2 inside the housing 1. A central throughhole 43 is formed in the circular insert 4 along its central axis for the insertion therein of the flat driving plate portion 23 of the circular axle 22 of the movable barrel 2. A plurality of stepped positioning holes 44 are formed in the circular insert 4 corresponding to the pin holes 34 of the fixed barrel 3 for the positioning therein of a plurality of springs.

The conductive plate 5 is an electrically conductive sheet plate comprising a central hole 51 for the insertion therethrough of the flat driving plate portion 23 of the circular axle 22 of the movable barrel 2, a contact point on its bottom surface connected with a lead wire 52, wherein the central hole 51 has a size relatively larger than the width of the flat driving plate portion 23 of the circular axle 22 to prevent erroneous electrical induction. The lead wire 52 is arranged to cooperate with another lead wire 53, which extends from the bottom end of the housing 1, to control an alarm device (not shown).

After the above-said component parts are assembled, the pin holes 24 of the movable barrel 2 are respectively set in communication with the pin holes 34 of the fixed barrel 3 to form a plurality of passageways for the setting therein of a plurality of lock pin assemblies. The lock pin assemblies each comprise an upper outer sleeve 61, a lower outer sleeve 62, an upper inner sleeve 71, a lower inner sleeve 72, an upper lock pin 81 and a lower lock pin 82.

The upper outer sleeve 61 and the lower outer sleeve 62 of each lock pin assembly have the same inner and outer diameters but different lengths and are respectively connected in series and received in the passage ways formed by the pin holes 24 and 34, wherein the upper outer sleeve 61 comprises a circular top portion 611 having a relatively smaller inner diameter.

The upper inner sleeve 71 and the lower inner sleeve 72 of each lock pin assembly have the same inner and outer diameters but different lengths and are respectively connected in series and received in the upper outer sleeve 61 and the lower outer sleeve 62, wherein the upper inner sleeve 71 comprises a circular top portion 711 having a relatively smaller inner diameter.

The upper lock pin 81 and the lower lock pin 82 of each lock pin assembly have the same inner and outer diameters but different lengths and are respectively connected in series and received in the upper inner sleeve 71 and the lower inner sleeve 72, wherein the upper lock pin 81 comprises a raised portion 811 on its top, and the lower lock pin 82 has a reduced diameter elongated extension 821 extending from its bottom.

Figure 3:
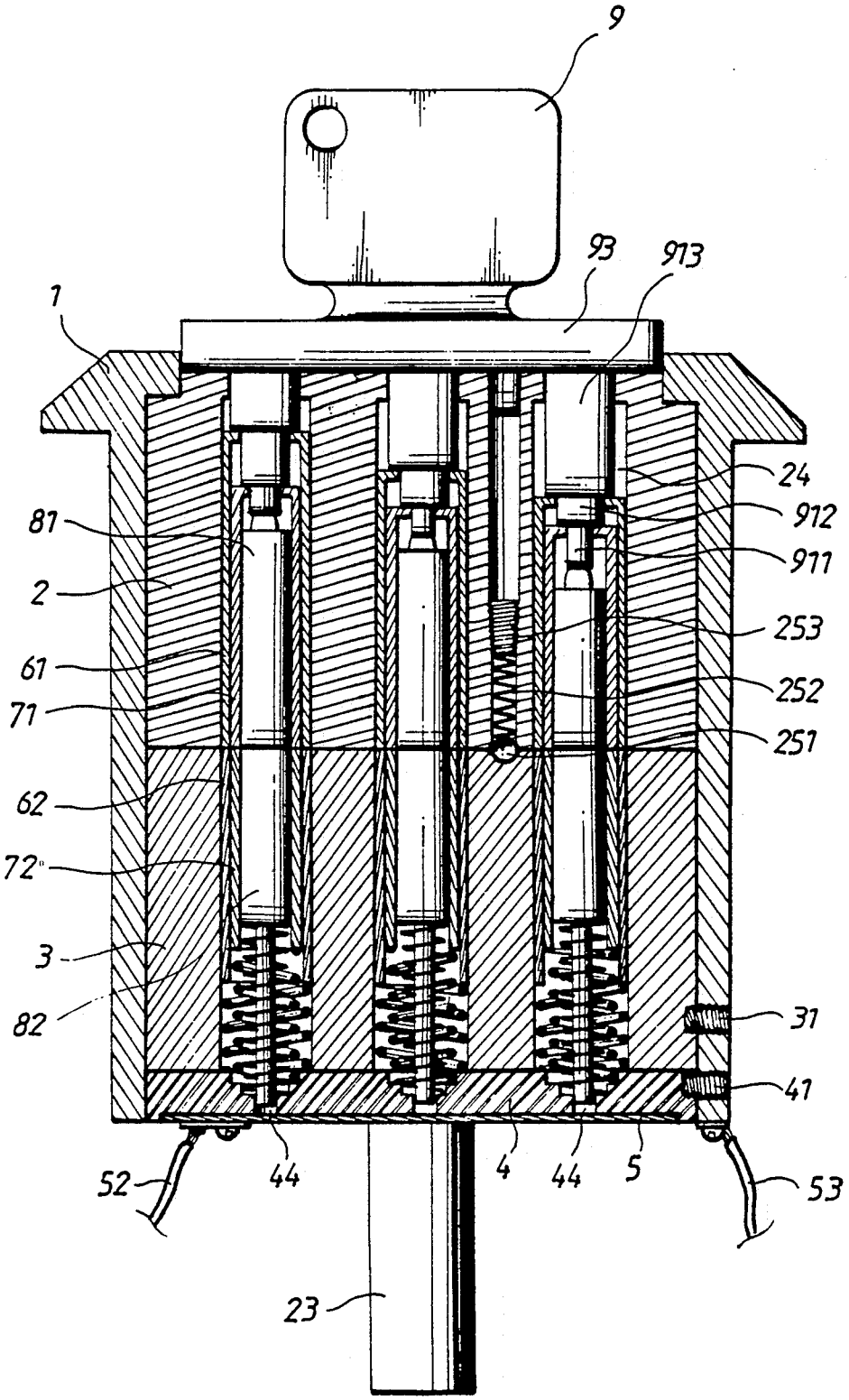
FIG. 3 is a sectional elevation view, in which the stepped pins of the key are respectively inserted in the movable lock barrel to perform an unlocking operation.

After each lock pin assembly is assembled, three compression springs 63, 73 and 83 of different diameters are respectively set in each of the stepped positioning holes 44 of the circular insert 4 to support the lower outer sleeve 62, the lower inner sleeve 72 and the lower lock pin 82 of each lock pin assembly, respectively (see FIG. 2). Because the upper outer sleeve and the lower outer sleeve 61 and 62, the upper inner sleeve and the lower inner sleeve 71 and 72, the upper lock pin and the lower lock pin 81 and 82 are different in length, a variety of code settings can be made according to the difference in the length of the component parts of the lock pin assemblies. Under normal conditions, the lock pin assemblies are respectively supported by the compression springs to lock up the device. When the upper lock pins 81 of the lock pin assemblies are respectively pressed down to the level of the upper inner sleeve 71, and the upper inner sleeves 71 are respectively moved to the level of the upper outer sleeves 61, the upper outer sleeves 61 and the lower outer sleeves 62 of the lock pin assemblies can be moved to such a position that the interfaces between the upper and the lower outer sleeves 61 and 62 of the lock pin assemblies are in alignment with the interface between the movable barrel 2 and the fixed barrel 3 (see FIG. 3) to release the lock from locking status. Under this condition, the lock pin assemblies can be turned to unlock the device.

As described above, the code setting of the lock body can be variously changed according to the variation of the length of the upper and lower outer sleeves 61 and 62, the upper and lower inner sleeves 71 and 72, and the upper and lower lock pins 81 and 82. In the present embodiment, there are three lock pin assemblies. When more lock pin assemblies are made on a lock body, more code settings can be provided.

To release the locking status of the lock pin assemblies, a key shall have stepped pins to respectively push the upper outer sleeves 61, the upper inner sleeves 71 and the upper lock pins 91 of the lock pin assemblies to align with the interface between the upper and lower cylinders 2 and 3. In the present embodiment, a key 9 includes three stepped pins 91 and each stepped pin 91 comprises three steps 911, 912 and 913. During operation, the first step 911 of each stepped pin 91 drives the upper lock pin 81 of each lock pin assembly to move it into alignment with the upper inner sleeve 71 and the second step 92 drives the upper inner sleeve 71 to align it with the upper outer sleeve 61. As soon as the third step 913 of each stepped pin 91 of the key 9 is moved downward to its limit, the upper outer sleeve 61 of each lock pin assembly is simultaneously moved to a level in alignment with the interface between the movable and fixed cylinders 2 and 3 to release the locking of the lock pin assemblies. Because the three steps 911, 912 and 913 of each stepped pin 91 of the key 9 are to respectively drive the upper outer sleeve 61, the upper inner sleeve 71 and the upper lock pin 81 of a corresponding lock pin assembly, the size of the stepped pins 91 of the key 9 is determined according to the size of the upper outer sleeve 61, the upper inner sleeve 71 and the upper lock pin 81 of the corresponding lock pin assembly.

As an alternate form of the present invention, the stepped pins 91 can be separately made and secured to the disc portion 93 of the key 9 by means of screws 92, such that the stepped pins 91 can be separately received by different people or in different locations to ensure security. The key 9 comprises an alignment pin 94 extending downward from its disc portion 93 at a position corresponding to the alignment hole 25 of the movable barrel 2. As soon as the alignment pin 94 of the key 9 is inserted in the alignment hole 25 of the movable barrel 2, the key 9 can be turned to unlock the lock body. In the alignment hole 25 of the movable barrel 2, there is inserted a steel ball 251 and a spring 252 respectively secured by a screw 253, permitting the steel ball 251 to partly protrude beyond the bottom of the movable barrel 2 and extend into the circular recess 35 of the fixed barrel 3. By means of the steel ball 251 to match with the circular recess 35, the positioning of the movable barrel 2 on the fixed barrel 3 can be accurately secured and noted.

An alarm device can be connected to the lock body via the lead wires 52 and 53 so as to provide an alarm signal when the lock body is triggered by an unauthorized key or any other object. If there is anybody trying to unlock the lock body of the present invention with an unauthorized key or other tools, the elongated extension 821 of the lower lock pin 82 of each of the lock pin assemblies will be pushed to contact the conductive plate 5 during the attempt to unlock the lock. Because all the component parts of the lock body are electrically conductive except the circular insert 4, when either one of the lock pin assemblies is triggered by any unauthorized key or other tools or objects to force its lower lock pin 81 to contact the conductive plate 5, the two lead wires 52 and 53 and the connected alarm device immediately form a closed circuit to produce an alarm signal to inform the subscriber. When an authorized key is used to unlock the lock body, the lower lock pins 81 of all lock pin assemblies of the lock body are prevented from contacting the conductive plate 5, and therefore, the two lead wires 52 and 53 remain disconnected.

Figure 4:
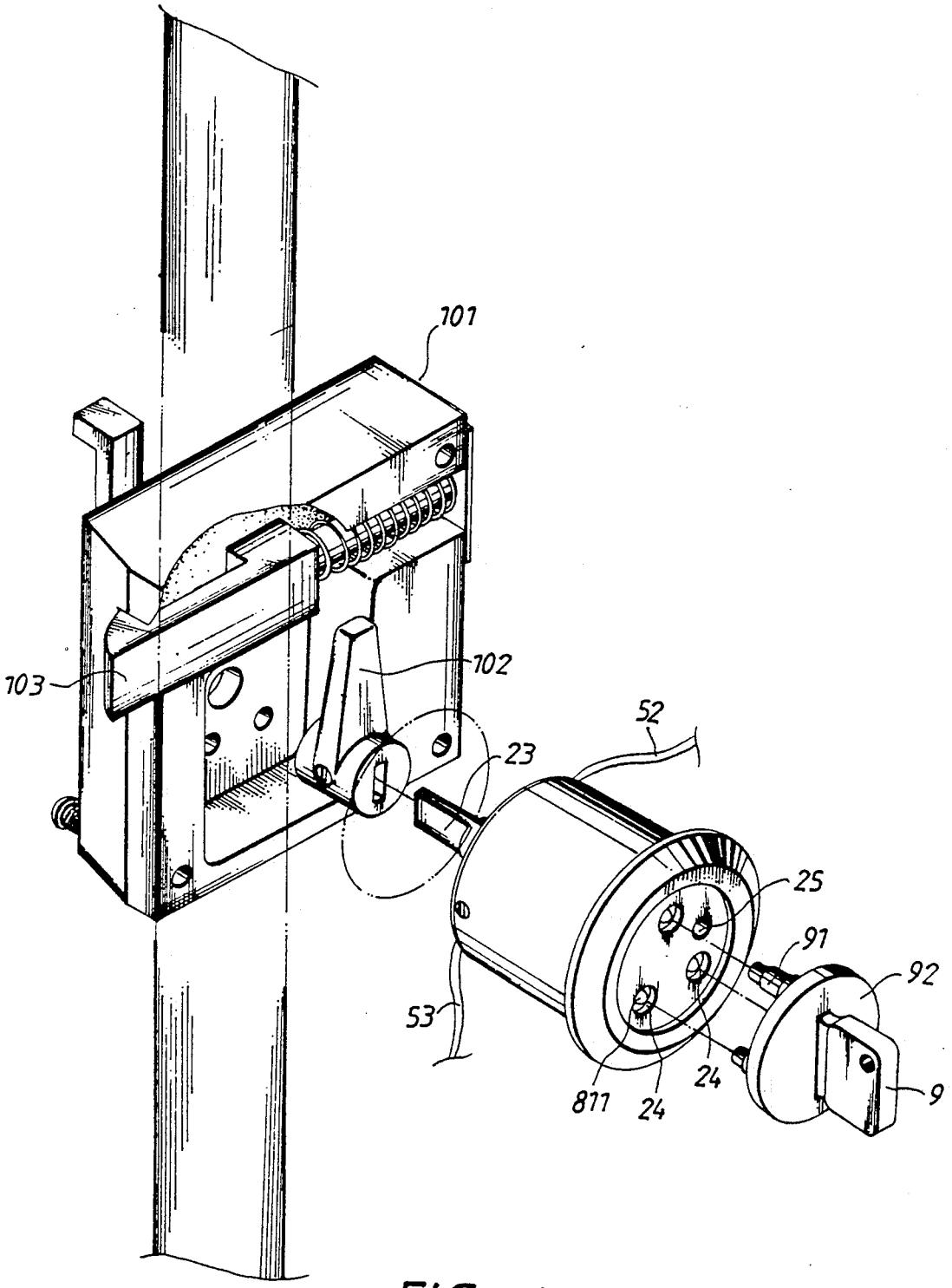
FIG. 4 is a schematic drawing illustrating the installation of a lock body in a lock case which is secured to a door frame.

With reference to FIG. 4, when a lock body of the present invention is mounted on a lock case (101) which is secured to a door frame, the driving plate portion 23 of the circular axle 22 of the movable barrel 2 of the lock body is inserted in a control bolt 102 to control the motion of a spring bolt 103 so as to lock or unlock a door.

We claim:

1. A cylinder lock comprising:

a cylindrical housing;

a fixed barrel fixedly mounted in said cylindrical housing, said fixed barrel having a plurality of pin holes formed axially therethrough adapted to receive a plurality of lock pin assemblies, respectively, a top surface, an axial alignment recess formed in said top surface, and an axle hole formed axially through a center thereof;

a movable barrel rotatably mounted above and adjacent said fixed barrel in said cylindrical housing for rotation about a central longitudinal axis, said movable barrel having a plurality of pin holes formed axially therethrough adapted to receive the plurality of lock pin assemblies, respectively, and an axial alignment hole formed axially therethrough and adapted to register with said vertical alignment recess formed in said top surface of said fixed barrel, said pin holes of said movable barrel being arranged such that upon a predetermined rotational position of said movable barrel, said pin holes of said movable barrel align with said pin holes of said fixed barrel to form lock pin holes;

an axle having a circular cross section along most of its length, having a flat portion at a bottom end thereof, and being integrally fixed to said movable barrel such that said axle extends downwardly from said movable barrel and is rotatably received within said axle hole formed in said fixed barrel; and a circular plate secured to a bottom end of said cylindrical housing below and adjacent said fixed barrel, said circular plate having a hole formed through a center thereof for insertion therethrough of said flat portion of said axle, and a plurality of positioning holes formed therethrough in registry with said plurality of pin holes of said fixed barrel, respectively, each of said plurality of positioning holes having a stepped sidewall with a plurality of stepped portions having respectively different diameters.

2. A cylinder lock as recited in claim 1, wherein each of said plurality of lock pin assemblies comprises:

an upper outer sleeve having a radially inwardly directed annular flange at an upper end thereof and being slidably mounted within a respective one of said lock pin holes;

a lower outer sleeve having a diameter equal to a diameter of said upper outer sleeve, having a length different from a length of said upper outer sleeve, and being slidably mounted within the respective one of said lock pin holes below said upper outer sleeve;

an upper inner sleeve having a radially inwardly directed annular flange at an upper end thereof and being slidably mounted for movement within said upper and lower outer sleeves;

a lower inner sleeve having a diameter equal to a diameter of said upper inner sleeve, having a length different than a length of said lower inner sleeve, and being slidably mounted below said upper inner sleeve for movement within said upper and lower outer sleeves;

an upper lock pin having a raised portion extending upwardly from a top end thereof and being slidably mounted for movement within said upper and lower inner sleeves; and a lower lock pin having a diameter equal to a diameter of said upper lock pin, having a length different than a length of said upper lock pin, having an elongated extension member extending downwardly from a bottom end thereof, and being slidably mounted for movement within said upper and lower inner sleeves, said elongated extension member being smaller in diameter than said lower lock pin.

3. A cylinder lock as recited in claim 2, wherein each of said pin holes of said movable barrel has an upper end which is smaller in diameter than a remainder thereof, so as to retain said lock pin assemblies within said lock pin holes.

4. A cylinder lock as recited in claim 2, wherein each of said plurality of upper outer sleeves, lower outer sleeves, upper inner sleeves, lower inner sleeves, upper lock pins and lower lock pins has a predetermined length so as to define a code setting.

5. A cylinder lock as recited in claim 2, further comprising an electrically conductive plate fixedly mounted adjacent a bottom surface of said circular plate and closing a bottom end of each of said plurality of positioning holes, said electrically conductive plate having a hole formed through a center thereof for extension therethrough of said flat portion of said axle; and wherein said circular plate is formed of electrically insulating material.

6. A cylinder lock as recited in claim 5, further comprising a pair of lead wires, attached to a bottom surface of said electrically conductive plate, adapted for connection to an alarm device, said elongated extension member of each of said lock pin assemblies being adapted to contact said electrically conductive plate so as to activate the alarm device upon tampering by an unauthorized person.

7. A cylinder lock as recited in claim 2, wherein each of said lock pin assemblies further comprises means for upwardly biasing said upper and lower outer sleeves, said upper and lower inner sleeves and said upper and lower lock pins.

8. A cylinder lock as recited in claim 7, wherein each of said means for upwardly biasing comprises a first compression spring mounted between said circular plate and said lower lock pin, a second compression spring mounted between said circular plate an d said lower inner sleeve and having a larger diameter than said first compression spring, and a third compression spring mounted between said circular plate and said lower outer sleeve and having a larger diameter than said second compression spring.

9. A cylinder lock as recited in claim 2, further comprising a key means for driving each of said plurality of lock pin assemblies downwardly within each of said lock pin holes, respectively, to thereby release a locking condition between said fixed barrel and said movable barrel and allow said movable barrel to rotate relative to said fixed barrel, said key means comprising a key body and a plurality of stepped pins extending downwardly therefrom and corresponding in number to the number of said plurality of lock pin holes, said plurality of stepped pins being individually detachably connected to said key body such that each of said plurality of stepped pins can be carried by a different person.

10. A cylinder lock as recited in claim 9, wherein each of said plurality of stepped pins includes a cylindrical lower step adapted to contact said raised portion of said upper lock pin, a cylindrical middle step having a diameter larger than a diameter of said lower step and being adapted to contact said upper outer sleeve, and a cylindrical upper step having a diameter larger than the diameter of said middle step and being adapted to contact said upper inner sleeve, each of said lower middle and upper steps having a length such that upon full insertion of said plurality of stepped pins into said plurality of lock pin holes, respectively the interface between said upper lock pin and said lower lock pin, the interface between said upper inner sleeve and said lower inner sleeve, and the interface between said upper outer sleeve and said lower outer sleeve align with the interface between said movable barrel and said fixed barrel.

11. A cylinder lock as recited in claim 1, further comprising a key means for driving each of said plurality of lock pin assemblies downwardly within each of said lock pin holes, respectively, to thereby release a locking condition between said fixed barrel and said movable barrel and allow said movable barrel to rotate relative to said fixed barrel, said key means comprising a key body and a plurality of stepped pins extending downwardly therefrom and corresponding in number to the number of said plurality of lock pin holes, said plurality of stepped pins being individually detachably connected to said key body such that each of said plurality of stepped pins can be carried by a different person.

12. A cylinder lock comprising:

a cylindrical housing;

a plurality of lock pin assemblies;

a fixed barrel fixedly mounted in said cylindrical housing, said fixed barrel having a plurality of pin holes formed axially therethrough adapted to receive said plurality of lock pin assemblies, respectively;

a movable barrel rotatably mounted above and adjacent said fixed barrel in said cylindrical housing for rotation about a central longitudinal axis, said movable barrel having a plurality of pin holes formed axially therethrough adapted to receive said plurality of lock pin assemblies, respectively, said pin holes of said movable barrel being arranged such that upon a predetermined rotational position of said movable barrel said pin holes of said movable barrel align with said pin holes of said fixed barrel to form lock pin holes; and a key means for driving each of said plurality of lock pin assemblies downwardly within each of said lock pin holes, respectively, to thereby release a locking condition between said fixed barrel and said movable barrel and allow said movable barrel to rotate relative to sad fixed barrel, said key means comprising a key body and a plurality of stepped pins extending downwardly therefrom and corresponding in number to the number of said plurality of lock pin holes, said plurality of stepped pins being individually detachably connected to said key body such that each of said plurality of stepped pins can be carried by a different person.

13. A cylinder lock as recited in claim 12, wherein each of said plurality of lock pin assemblies comprises:

an upper outer sleeve having a radially inwardly directed annular flange at an upper end thereof and being slidably mounted within a respective one of said lock pin holes;

a lower outer sleeve having a diameter equal to a diameter of said upper outer sleeve, having a length different from a length of said upper outer sleeve, and being slidably mounted within the respective one of said lock pin holes below said upper outer sleeve;

an upper inner sleeve having a radially inwardly directed annular flange at an upper end thereof and being slidably mounted for movement within said upper and lower outer sleeves;

a lower inner sleeve having a diameter equal to a diameter of said upper inner sleeve, having a length different than a length of said lower inner sleeve, and being slidably mounted below said upper inner sleeve for movement within said upper and lower outer sleeves;

an upper lock pin having a raised portion extending upwardly from a top end thereof and being slidably mounted for movement within said upper and lower inner sleeves; and a lower lock pin having a diameter equal to a diameter of said upper lock pin, having a length different than a length of said upper lock pin, having an elongated extension member extending downwardly from a bottom end thereof, and being slidably mounted for movement within said upper and lower inner sleeves, said elongated extension member being smaller in diameter than said lower lock pin.

14. A cylinder lock as recited in claim 13, wherein each of said plurality of stepped pins includes a cylindrical lower step adapted to contact said raised portion of said upper lock pin, a cylindrical middle step having a diameter larger than a diameter of said lower step and being adapted to contact said upper outer sleeve, and a cylindrical upper step having a diameter larger than the diameter of said middle step and being adapted to contact said upper inner sleeve, each of said lower middle and upper steps having a length such that upon full insertion of said plurality of stepped pins into said plurality of lock pin holes, respectively, the interface between said upper lock pin and said lower lock pin, the interface between said upper inner sleeve and said lower inner sleeve, and the interface between said upper outer sleeve and said lower outer sleeve align with the interface between said movable barrel and said fixed barrel.

15. A cylinder lock as recited in claim 13, wherein each of said pin holes of said movable barrel has an upper end which is smaller in diameter than a remainder thereof, so as to retain said lock pin assemblies within said lock pin holes.

16. A cylinder lock as recited in claim 13, wherein each of said plurality of upper outer sleeves, lower outer sleeves, upper inner sleeves, lower inner sleeves, upper lock pins and lower lock pins has a predetermined length so as to define a code setting.

17. A cylinder lock as recited in claim 13, wherein each of said lock pin assemblies further comprises mans for upwardly biasing said upper and lower outer sleeves, said upper and lower inner sleeves and said upper and lower lock pins.

18. A cylinder lock as recited in claim 17, wherein each of said means for upwardly biasing comprises a first compression spring mounted between said circular plate and said lower lock pin, a second compression spring mounted between said circular plate and said lower inner sleeve and having a larger diameter than said first compression spring, and a third compression spring mounted between said circular plate and said lower outer sleeve and having a larger diameter than said second compression spring.

19. A cylinder lock as recited in claim 13, further comprising a circular plate fixedly mounted adjacent a bottom end of said cylindrical housing below and adjacent said fixed barrel and having a plurality of positioning holes formed therethrough in registry with said plurality of pin holes of said fixed barrel respectively, said circular plate being formed of electrically insulating material; and an electrically conductive plate fixedly mounted adjacent a bottom surface of said circular plate and closing a bottom end of each of said plurality of positioning holes.

20. A cylinder lock as recited in claim 19, further comprising a pair of lead wires, attached to a bottom surface of said electrically conductive plate, adapted for connection to an alarm device, said elongated extension member of each of said lock pin assemblies being adapted to contact said electrically conductive plate so as to activate the alarm device upon tampering by an unauthorized person.

* * * * *